US007399265B2

(12) United States Patent
Bergmann et al.

(10) Patent No.: US 7,399,265 B2
(45) Date of Patent: Jul. 15, 2008

(54) APPARATUS AND METHOD FOR ADJUSTING A FOLDING-JAW CYLINDER OF A FOLDER FOR A PRINTING PRESS

(75) Inventors: Stephan Bergmann, Plauen (DE); Karsten Stansch, Plauen (DE)

(73) Assignee: MAN Roland Druckmaschinen AG, Augsburg (DE)

( * ) Notice: Subject to any disclaimer, the term of this patent is extended or adjusted under 35 U.S.C. 154(b) by 0 days.

(21) Appl. No.: 11/433,368

(22) Filed: May 12, 2006

(65) Prior Publication Data

US 2006/0276319 A1 Dec. 7, 2006

(30) Foreign Application Priority Data

May 13, 2005 (DE) ..... 10 2005 022 232

(51) Int. Cl.
*B31F 1/10* (2006.01)

(52) U.S. Cl. ..... 493/424; 493/476

(58) Field of Classification Search ..... 493/424, 493/425, 426, 442, 475, 476; 270/20.1
See application file for complete search history.

(56) References Cited

U.S. PATENT DOCUMENTS

| | | | | |
|---|---|---|---|---|
| 5,215,014 | A * | 6/1993 | Burger et al. | 493/424 |
| 5,507,714 | A * | 4/1996 | Furuta et al. | 493/475 |
| 5,637,072 | A * | 6/1997 | Michaelis | 493/476 |
| 5,830,120 | A * | 11/1998 | Rumesz et al. | 493/424 |
| 6,358,192 | B1 * | 3/2002 | Michalik | 493/424 |
| 6,398,704 | B1 * | 6/2002 | Shibuya et al. | 493/424 |
| 6,730,011 | B2 * | 5/2004 | Tokiwa et al. | 493/424 |
| 6,740,022 | B2 * | 5/2004 | Hachiya et al. | 493/424 |
| 6,779,788 | B2 * | 8/2004 | Takahashi et al. | 493/424 |

FOREIGN PATENT DOCUMENTS

| | | |
|---|---|---|
| DE | 40 35 617 A1 | 7/1991 |
| DE | 40 37 130 A1 | 11/1991 |
| DE | 41 03 160 C2 | 8/1992 |
| DE | 44 31 016 C2 | 3/1995 |
| DE | 44 04 752 C2 | 8/1995 |
| DE | 295 07 222 U1 | 8/1995 |
| DE | 44 15 620 C2 | 11/1995 |
| DE | 101 04 411 C2 | 8/2002 |
| DE | 102 06 578 C1 | 9/2003 |

(Continued)

*Primary Examiner*—Louis Huynh
(74) *Attorney, Agent, or Firm*—Crowell & Moring LLP

(57) ABSTRACT

A folding-jaw cylinder of a folder for a printing press is disclosed. Actuable folding-jaw cheeks are assigned to a first cylinder part of the folding-jaw cylinder and fixed folding-jaw cheeks are assigned to a second cylinder part. Both cylinder parts are assigned one shaft, via which the cylinder parts can be driven rotationally. An intermediate gear is coupled on one side to a drive and on the other side to at least one actuating unit in such a way that the intermediate gear can be driven by the drive and inputs its drive into at least one of the shafts of the cylinder parts via the, or every, actuating unit, and the, or every, actuating unit is assigned an adjusting drive in order to adjust the two cylinder parts, and therefore the folding-jaw cheeks which are assigned to the cylinder parts, relative to one another.

11 Claims, 3 Drawing Sheets

FOREIGN PATENT DOCUMENTS

| | | | |
|---|---|---|---|
| DE | 103 31 476 | A1 | 2/2005 |
| EP | 0 453 868 | A1 | 10/1991 |
| EP | 1 323 658 | A2 | 7/2003 |
| GB | 2 286 387 | A | 8/1995 |
| WO | WO 03/070612 | A1 | 8/2003 |

* cited by examiner

APPARATUS AND METHOD FOR ADJUSTING A FOLDING-JAW CYLINDER OF A FOLDER FOR A PRINTING PRESS

This application claims the priority of German Patent Document No. 10 2005 022 232.3, filed May 13, 2005, the disclosure of which is expressly incorporated by reference herein.

BACKGROUND AND SUMMARY OF THE INVENTION

The invention relates to a folding-jaw cylinder of a folder for a printing press.

German Patent Document No. DE 44 15 620 C2 discloses a folding-jaw cylinder for a folder of a printing press. The folding-jaw cylinder which is disclosed there has a plurality of folding jaws which are formed in each case by an actuable or movable folding-jaw cheek (controlled folding jaw) and a fixed or immovable folding-jaw cheek (fixed corresponding jaw). The actuable or movable folding-jaw cheeks are assigned to a first cylinder part (discs) and the fixed or immovable folding-jaw cheeks are assigned to a second cylinder part (cylinder body). The discs which form the first cylinder part and the cylinder body which forms the second cylinder part are mounted rotatably on a common axle or shaft, the second cylinder part having the fixed folding-jaw cheeks being positioned between the discs which serve to mount the actuable folding-jaw cheeks. The two cylinder parts can be adjusted relative to one another, in order to set the opening width or mouth width of the folding jaws. In DE 44 15 620 C2, the two cylinder parts can be adjusted relative to one another or the actuable folding-jaw cheeks can be adjusted relative to the fixed folding-jaw cheeks with the aid of an adjusting eccentric bolt which is to be actuated manually.

Proceeding from this, the present invention is based on the problem of providing a novel folding-jaw cylinder of a folder for a printing press.

According to the invention, both cylinder parts are assigned in each case one shaft, via which the cylinder parts can be driven rotationally, an intermediate gear being positioned coaxially with respect to the shafts of the cylinder parts and being mounted rotatably with respect to the shafts, the intermediate gear being coupled on one side to a drive and on the other side to at least one actuating unit in such a way that the intermediate gear can be driven by the drive and inputs its drive into at least one of the shafts of the cylinder parts via the, or every, actuating unit, and the, or every, actuating unit being assigned an adjusting drive, in order to adjust the two cylinder parts and therefore the folding-jaw cheeks which are assigned to the cylinder parts relative to one another.

Within the meaning of the present invention, a folding-jaw cylinder of a folder for a printing press is provided, it being possible to adjust the two cylinder parts of the folding-jaw cylinder relative to one another by motor and in an automated manner (it also being conceivable manually via a handwheel, however), which cylinder parts are assigned firstly the actuable folding-jaw cheeks and secondly the fixed folding-jaw cheeks. Every cylinder part is assigned a shaft, via which the cylinder parts are driven rotationally. An intermediate gear is positioned coaxially with respect to the shafts of the two cylinder parts, which intermediate gear is mounted such that it can rotate freely with respect to the shafts. The intermediate gear which is mounted coaxially on the two shafts is coupled on one side to a drive and on the other side to at least one actuating unit. The intermediate gear can be driven by the drive. The intermediate gear inputs its drive into at least one of the shafts of the two cylinder parts via the, or every, actuating unit. Furthermore, the, or every, actuating unit is assigned an adjusting drive, in order to adjust the two cylinder parts relative to one another and therefore the actuable and fixed folding-jaw cheeks which are assigned to the two cylinder parts, in order to adapt the opening width or mouth width of the folding jaws. The folding-jaw cylinder according to the invention is of simple construction and permits both symmetrical and asymmetrical adjustment of the actuable and fixed folding-jaw cheeks relative to one another during the adaptation of the opening width or mouth width of the folding jaws. The adjustment is low in play, reliable and very precise.

BRIEF DESCRIPTION OF THE DRAWINGS

Preferred developments of the invention result from the following description. Exemplary embodiments of the invention are explained in greater detail using the drawings, without being restricted thereto. In the drawings.

DETAILED DESCRIPTION OF THE DRAWINGS

In the following text, the present invention will be described in greater detail with reference to FIGS. 1 to 3.

Figure 1:
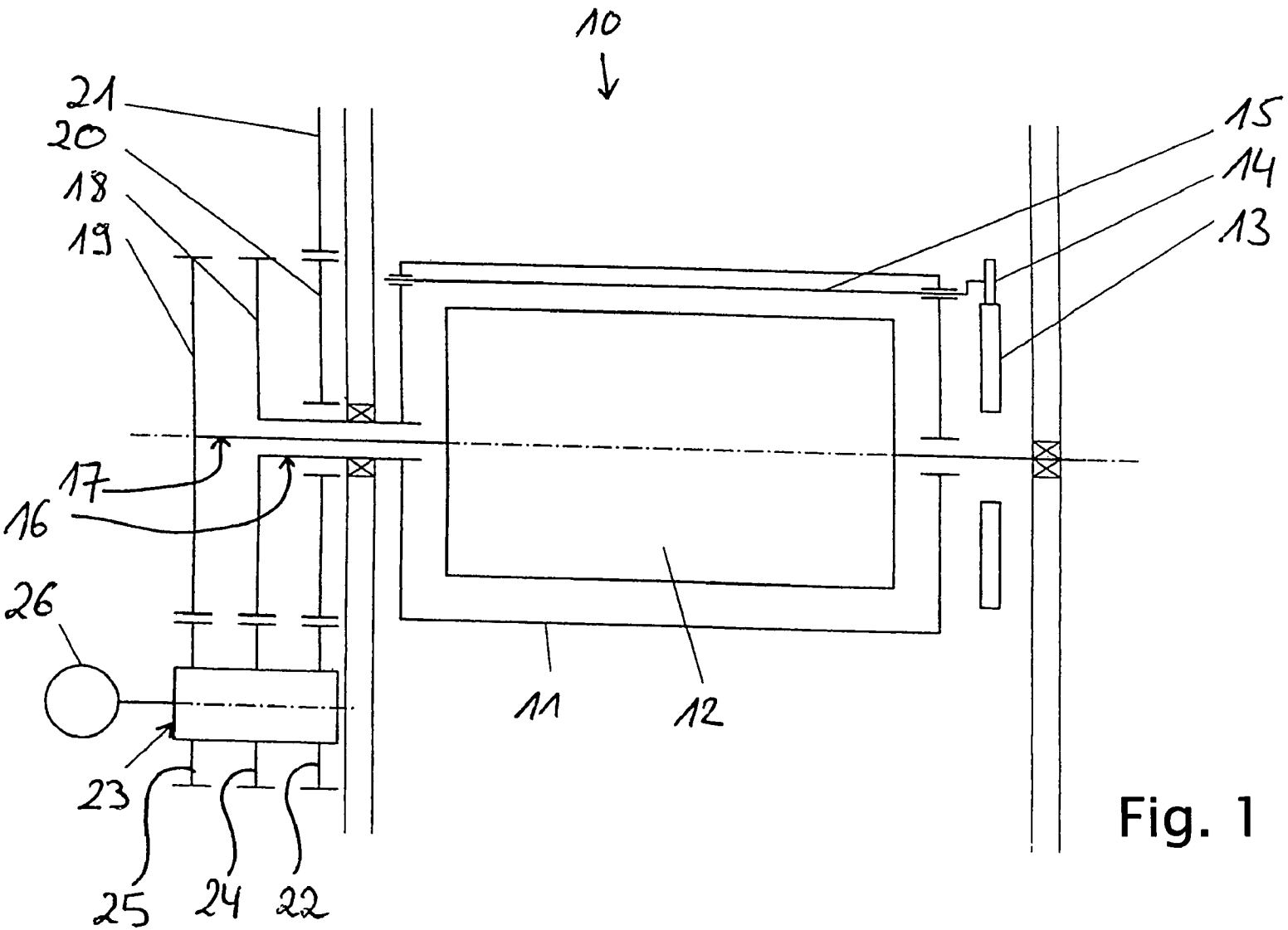
FIG. 1 shows a diagrammatic illustration of a folding-jaw cylinder according to the invention of a folder for a printing press, according to a first exemplary embodiment of the invention.

FIG. 1 shows a first exemplary embodiment of a folding-jaw cylinder 10 according to the invention of a folder. The folding-jaw cylinder 10 of FIG. 1 is of two-piece construction comprising two cylinder parts 11 and 12, a first cylinder part 11 being assigned actuable or movable folding-jaw cheeks and a second cylinder part 12 being assigned fixed or immovable folding-jaw cheeks. Within the context of the invention, it goes without saying that all the folding-jaw cheeks can also be movable and actuable.

The actuable or movable folding-jaw cheeks and the fixed or immovable folding-jaw cheeks form the folding jaws. As FIG. 1 shows, the movable folding-jaw cheeks which are assigned to the first cylinder part 11 are actuated via a cam disc 13, a control roller 14 rolling on the cam disc 13, which control roller 14 actuates the movable folding-jaw cheeks via an actuating device 15.

Both cylinder parts 11 and 12 are assigned in each case one shaft 16 and 17, it being possible to drive the cylinder parts 11 and 12 via the shafts 16 and 17. According to FIG. 1, the first cylinder part 11 is assigned the shaft 16 and the second cylinder part 12 is assigned the shaft 17, both shafts 16 and 17 being arranged coaxially with respect to one another and enclosing one another concentrically at least in sections. Both shafts 16 and 17 are assigned in each case one input gear 18 and 19, respectively, which is connected fixedly or non-rotatably to the respective shaft 16 and 17, respectively, and which serves to drive the shafts 16 and 17 and therefore the cylinder parts 11 and 12, respectively.

The folding-jaw cylinder 10 has an intermediate gear 20 which is positioned coaxially with respect to the shafts 16 and 17 and is mounted rotatably with respect to the shafts 16 and 17. The intermediate gear 20 is coupled on one side to a drive gear 21 of a drive and on the other side to an input gear 22 of an actuating unit 23. In the exemplary embodiment of FIG. 1, in addition to the input gear 22, the actuating unit 23 has two output gears 24 and 25, the output gear 24 being coupled to the input gear 18 which is mounted on the shaft 16 and the output gear 25 being coupled to the input gear 19 which is mounted on the shaft 17.

Accordingly, the intermediate gear 20 is driven via the drive gear 21 of the drive, which intermediate gear 20 inputs its drive into the actuating unit 23 via the input gear 22, in order to drive the two cylinder parts 11 and 12 rotationally via the output gears 24 and 25 of the actuating unit 23 and the input gears 18 and 19 which are assigned to the shafts 16 and 17.

As a result of the diameter ratios shown in FIG. 1 of the output gears 24 and 25 relative to the input gears 18 and 19, both cylinder parts 11 and 12 are driven at identical rotational speeds during operation of the folding-jaw cylinder 10.

The internal transmission ratio of the actuating unit (harmonic drive) is compensated for by a suitable selection of the number of teeth of the output gears and input gears.

According to FIG. 1, the actuating unit 23 is assigned an adjusting drive 26. With the aid of the adjusting drive 26, the relative distance between the actuable or movable folding-jaw cheeks and the fixed or immovable folding-jaw cheeks of the folding jaws of the folding-jaw cylinder 10 can be set in order to set the opening width or mouth width of the folding jaws. For this purpose, the adjusting drive 26 inputs its drive into the actuating unit 23, it being possible for the two cylinder parts 11 and 12 to be adjusted with respect to one another via the actuating unit 23 symmetrically or else asymmetrically. Accordingly, with the aid of the adjusting drive 26, a movement component can be superimposed on the movement of the cylinder parts 11 and 12 which is provided by the drive gear 21, in order to adjust the cylinder parts 11 and 12 relative to one another independently of what is known as the main drive which is provided by the drive gear 21. The adjustment can take place during a standstill and when the machine is running.

Figure 2:
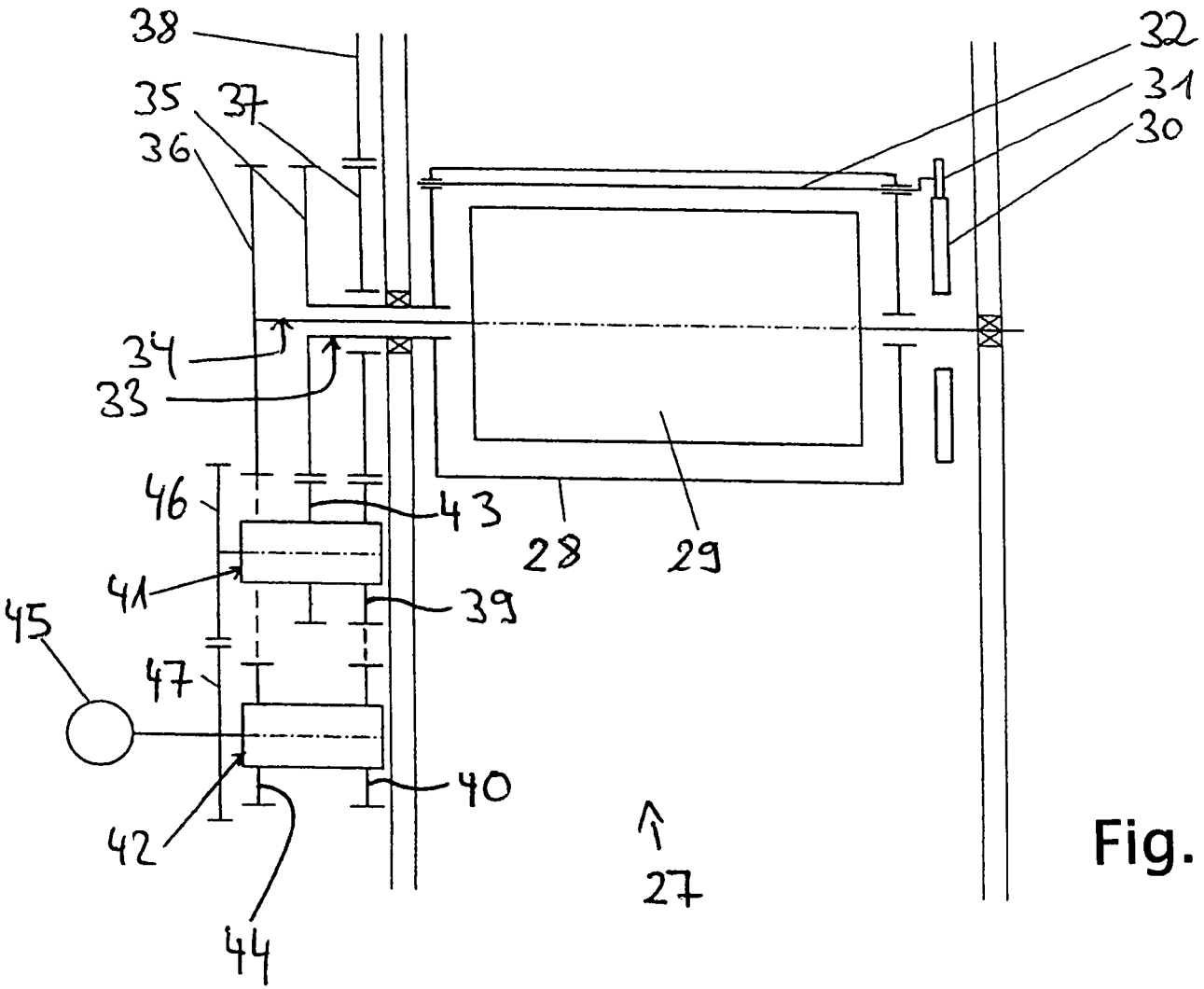
FIG. 2 shows a diagrammatic illustration of a folding-jaw cylinder according to the invention of a folder for a printing press, according to a second exemplary embodiment of the invention.

FIG. 2 shows a second exemplary embodiment of a folding-jaw cylinder 27 according to the invention. Like the folding-jaw cylinder 10 of the exemplary embodiment of FIG. 1, the folding-jaw cylinder 27 of the exemplary embodiment of FIG. 2 likewise has two cylinder parts 28 and 29, a first cylinder part 28 again being assigned the actuable or movable folding-jaw cheeks and a second cylinder part 29 being assigned the fixed or immovable folding-jaw cheeks. The movable folding-jaw cheeks are actuated via a cam disc 30, on which a control roller 31 rolls which interacts with an actuating device 32 in order to actuate the movable folding-jaw cheeks.

Each of the two cylinder parts 28 and 29 is again assigned in each case one shaft 33 and 34, respectively, with an input gear 35 and 36, respectively, which is mounted fixedly in terms of rotation on the respective shaft 33 and 34, respectively. Here, the shaft 33 with the input gear 35 interacts with the first cylinder part 28 and the shaft 34 with the input gear 36 interacts with the second cylinder part 29. An intermediate gear 37 is also positioned coaxially with respect to both shafts 33 and 34 in the exemplary embodiment of FIG. 2, which intermediate gear 37 is mounted freely rotatably with respect to the shafts 33 and 34.

The intermediate gear 37 is coupled to a drive gear 38 of a drive and, furthermore, according to FIG. 2, to input gears 39 and 40 of two actuating units 41 and 42. In addition to the input gear 39 and 40, respectively, each of the two actuating units 41 and 42 has in each case one output gear 43 and 44, respectively, the output gear 43 of the actuating unit 41 being coupled to the input gear 35 of the shaft 33 and the output gear 44 of the actuating unit 42 being coupled to the input gear 36 of the shaft 34. Accordingly, in contrast to the exemplary embodiment of FIG. 1, each of the two cylinder parts 28 and 29 is assigned a dedicated actuating unit 41 and 42, respectively, in the exemplary embodiment of FIG. 2.

An adjusting drive 45 interacts with both actuating units 41 and 42, which adjusting drive 45 inputs its drive into the actuating units 41 and 42 via input gears 46 and 47, respectively, in order to adjust the cylinder parts 28 and 29 relative to one another for adaptation of the opening width or mouth width of the folding jaws. This adjustment can again take place symmetrically or else asymmetrically, and independently of what is known as the main drive which is provided by the drive gear 38.

In the exemplary embodiments of FIGS. 1 and 2, the actuating units are preferably configured as what are known as harmonic drive gear mechanisms.

Figure 3:
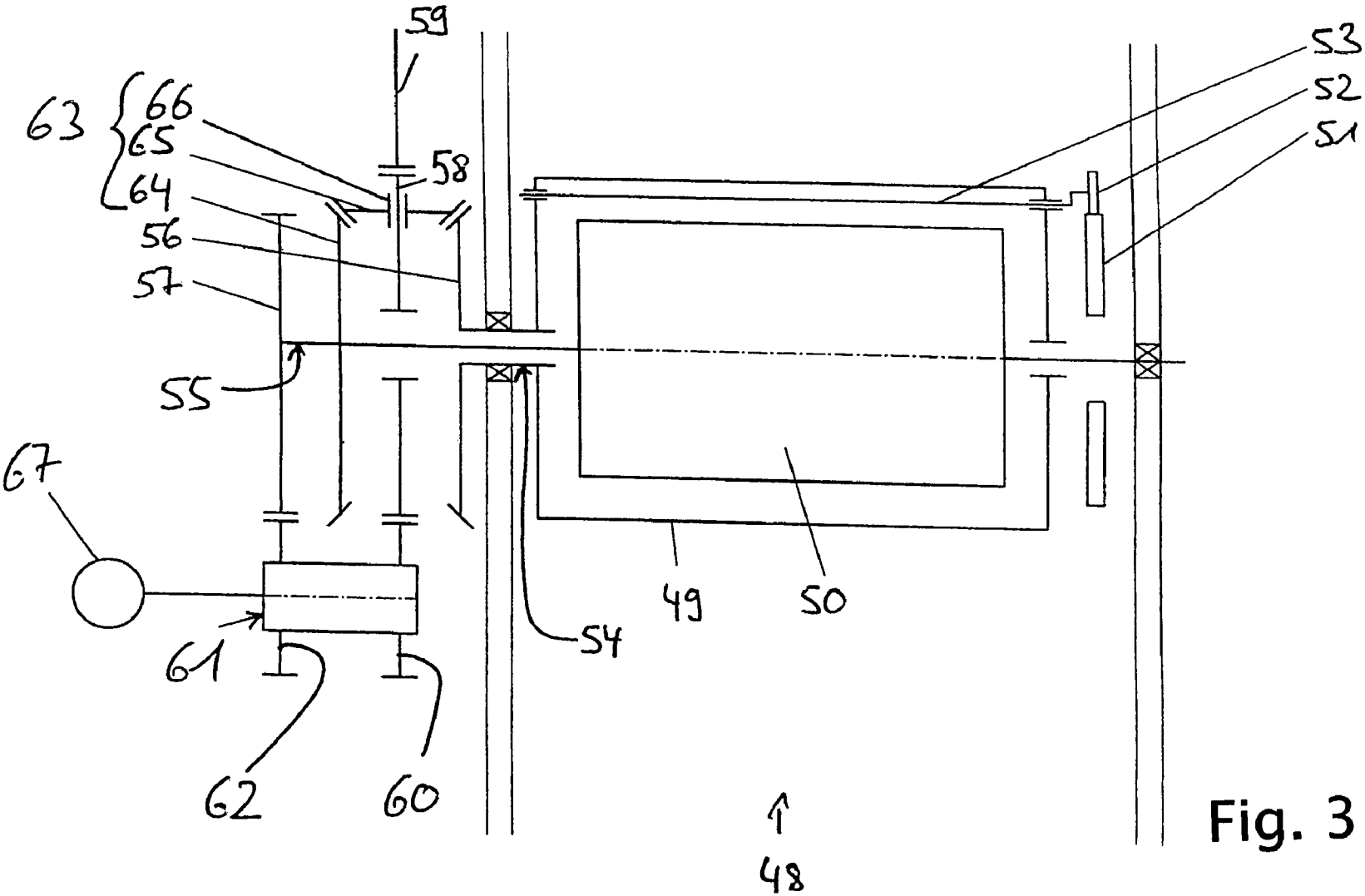
FIG. 3 shows a diagrammatic illustration of a folding-jaw cylinder according to the invention of a folder for a printing press, according to a third exemplary embodiment of the invention.

FIG. 3 shows a further exemplary embodiment of a folding-jaw cylinder 48 according to the invention. The folding-jaw cylinder 48 of FIG. 3 also has two cylinder parts 49, 50, a first cylinder part 49 being assigned movable or actuable folding-jaw cheeks and a second cylinder part 50 being assigned immovable or fixed folding-jaw cheeks. The movable folding-jaw cheeks are again actuated via a cam disc 51, on which a control roller 52 rolls which interacts with an actuating device 53 for actuating the movable folding-jaw cheeks. Both cylinder parts 49, 50 are assigned in each case one shaft 54 and 55, respectively, on which input gears 56 and 57, respectively, are mounted fixedly in terms of rotation or non-rotatably. According to FIG. 3, the shaft 54 with the input gear 56 interacts with the first cylinder part 49 and the shaft 55 with the input gear 57 interacts with the second cylinder part 50.

In the exemplary embodiment of FIG. 3, an intermediate gear 58 is also positioned coaxially with respect to the two shafts 54 and 55, which intermediate gear 58 is mounted with respect to the shafts 54 and 55 so as to rotate freely on the latter. The intermediate gear 58 is coupled to a drive gear 59 of a drive and, furthermore, according to FIG. 3, to an input gear 60 of an actuating unit 61. In the exemplary embodiment of FIG. 3, there is a single actuating unit 61 which has a single output gear 62 which, according to FIG. 3, is coupled to the input gear 57 which is mounted on the shaft 55. The drive of the shaft 55 and therefore of the second cylinder part 50 takes place via this.

The drive is likewise input into the input gear 56 which is assigned to the shaft 54 for driving the cylinder part 49 via the shaft 55 which is assigned to the cylinder part 50, to be precise via a differential gear mechanism or bevel gear mechanism 63. The bevel gear mechanism 63 is formed by the input gear 56 which is assigned to the shaft 54 and is configured as a bevel gear and by a bevel gear 64 which is assigned to the shaft 55, what is known as a bevel pinion 65 interacting with these two bevel gears 56 and 64. According to FIG. 3, the bevel pinion 65 is mounted rotatably on the intermediate gear 58 via a guide 66. There is a mechanical coupling between the two cylinder parts 49 and 50 via the bevel gear mechanism 63.

For the relative adjustment of the two cylinder parts 49 and 50, the actuating unit 61 is again assigned an adjusting drive 67, a symmetrical adjustment, which is independent of the drive or the drive gear 59, of the two cylinder parts 49 and 50 relative to one another being possible via the adjusting drive 67.

A common feature of all the exemplary embodiments of FIGS. 1 to 3 is that the two cylinder parts of the folding-jaw cylinder are assigned in each case one shaft, an intermediate gear being positioned coaxially with respect to these two shafts which is coupled to a drive. The intermediate gear inputs its drive into the cylinder parts of the folding-jaw cylinder with at least one actuating unit being connected in between.

The, or every, actuating unit is assigned an adjusting drive, via which the two cylinder parts can be adjusted relative to one another independently of the main drive, in order to set the opening width or mouth width of folding jaws of the folding-jaw cylinder. Here, the adjustment of the two cylinder parts with respect to one another can take place symmetrically or else asymmetrically.

The, or every, actuating unit for the relative adjustment of the cylinder parts with respect to one another is arranged outside the folding-jaw cylinder on a drive side of the folder, with the result that no corresponding actuating elements are integrated into the folding-jaw cylinder. The measures which would otherwise be necessary for dust protection and for the maintenance of corresponding components in the folding-jaw cylinder are therefore omitted.

LIST OF REFERENCE NUMERALS

10 Folding-jaw cylinder
11 Cylinder part
12 Cylinder part
13 Cam disc
14 Control roller
15 Actuating device
16 Shaft
17 Shaft
18 Input gear
19 Input gear
20 Intermediate gear
21 Drive gear
22 Input gear
23 Actuating unit
24 Output gear
25 Output gear
26 Adjusting drive
27 Folding-jaw cylinder
28 Cylinder part
29 Cylinder part
30 Cam disc
31 Control roller
32 Actuating device
33 Shaft
34 Shaft
35 Input gear
36 Input gear
37 Intermediate gear
38 Drive gear
39 Input gear
40 Input gear
41 Actuating unit
42 Actuating unit
43 Output gear
44 Output gear
45 Adjusting drive
46 Input gear
47 Input gear
48 Folding-jaw cylinder
49 Cylinder part
50 Cylinder part
51 Cam disc
52 Control roller
53 Actuating device
54 Shaft
55 Shaft
56 Input gear
57 Input gear
58 Intermediate gear
59 Drive gear
60 Input gear
61 Actuating unit
62 Output gear
63 Bevel gear mechanism
64 Bevel gear
65 Bevel pinion
66 Guide
67 Adjusting drive The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

What is claimed is:

1. A method for adjusting a folding-jaw cylinder of a folder for a printing press, comprising the steps of:

driving an intermediate gear by a drive unit, wherein the intermediate gear is positioned coaxially with respect to a first shaft of a first cylinder part of the folding-jaw cylinder and a second shaft of a second cylinder part of the folding-jaw cylinder;

driving an actuating unit by the intermediate gear;

inputting a drive into the actuating unit by an adjusting drive, wherein said actuating unit comprises an internal input gear and an internal output gear having a different number of teeth from the internal input gear for changing a drive that is input to the actuating unit to a drive that is output from the actuating unit; and driving the first and second shafts of the first and second cylinder parts, respectively, by the actuating unit.

2. The method according to claim 1, wherein the actuating unit drives the first and second shafts of the first and second cylinder parts, respectively, by driving a first input gear mounted on the first shaft and by driving a second input gear mounted on the second shaft.

3. A folding-jaw cylinder of a folder for a printing press, having a plurality of folding jaws, first actuable folding-jaw cheeks of every folding jaw being assigned to a first cylinder part and second fixed folding-jaw cheeks of every folding jaw being assigned to a second cylinder part, wherein the two cylinder parts are adjustable relative to one another in order to set an opening width of the folding jaws, wherein both cylinder parts are each assigned one shaft, via which the cylinder parts are rotationally drivable, and wherein an intermediate gear is positioned coaxially with respect to the shafts of the cylinder parts and is mounted rotatably with respect to the shafts, the intermediate gear being coupled on a first side to a drive and on a second side to at least one actuating unit in such a way that the intermediate gear is drivable by the drive and a drive from the intermediate gear is input into at least one of the shafts of the cylinder parts via the, or each, actuating unit, and wherein the, or each, actuating unit is assigned an adjusting drive in order to adjust the two cylinder parts, and therefore the folding-jaw cheeks which are assigned to the cylinder parts, relative to one another, wherein said actuating unit comprises an internal input gear and an internal output gear having a different number of teeth from the internal input gear for changing a drive that is input to the actuating unit to a drive that is output from the actuating unit.

4. The folding-jaw cylinder according to claim 1, wherein the intermediate gear is coupled to a drive gear of the drive and an input gear of at least one actuating unit and wherein the, or each, actuating unit inputs a drive from the actuating unit into at least one of the shafts of the cylinder parts via at least one output gear.

5. The folding-jaw cylinder according to claim 4, wherein every output gear of every actuating unit is coupled to an input gear which is assigned to a respective shaft of the cylinder parts and wherein each input gear is connected fixedly in terms of rotation to the respective shaft.

6. The folding-jaw cylinder according to claim 1, wherein the actuating unit has an input gear which is coupled to a drive gear of the drive via the intermediate gear and has two output gears, wherein each output gear is coupled to a respective shaft of the two cylinder parts via an input gear which is mounted fixedly in terms of rotation on the respective shaft.

7. The folding-jaw cylinder according to claim 1, wherein the actuating unit and a second actuating unit each have an input gear which is coupled to a drive gear of the drive via the intermediate gear and wherein the actuating unit and the second actuating unit each have an output gear which is coupled to a respective shaft of the two cylinder parts via an input gear which is mounted fixedly in terms of rotation on the respective shaft and wherein the adjusting drive is coupled to both the actuating unit and the second actuating unit for driving the actuating unit and the second actuating unit in order to adjust the two cylinder parts relative to one another.

8. The folding-jaw cylinder according to claim 1, wherein the actuating unit has an input gear which is coupled to a drive gear of the drive via the intermediate gear and has an output gear which is coupled to the shaft of one of the two cylinder parts via an input gear which is mounted fixedly in terms of rotation on the shaft, and wherein the shaft which is coupled to the output gear of the actuating unit is coupled to the shaft of the other cylinder part for inputting drive into the shaft of the other cylinder part via a differential gear mechanism or a bevel gear mechanism.

9. A folding-jaw cylinder of a folder for a printing press, comprising:

a first cylinder part having actuable folding-jaw cheeks and a first shaft for rotationally driving the first cylinder part;

a second cylinder part having fixed folding-jaw cheeks and a second shaft for rotationally driving the second cylinder part;

a drive unit;

an intermediate gear positioned coaxially with respect to the first and second shafts and rotatably mounted on the shafts and wherein the intermediate gear is coupled to the drive unit on a first side of the intermediate gear;

an actuating unit coupled to the intermediate gear on a second side of the intermediate gear and coupled to the first and second shafts; and an adjusting drive coupled to the actuating unit;

wherein said actuating unit comprises an internal input gear and an internal output gear having a different number of teeth from the internal input gear for changing a drive that is input to the actuating unit to a drive that is output from the actuating unit.

10. The folding-jaw cylinder according to claim 9, wherein the actuating unit is coupled to the first shaft by a first input gear which is mounted on the first shaft and is coupled to the second shaft by a second input gear which is mounted on the second shaft.

11. The folding-jaw cylinder according to claim 9, wherein the actuating unit is located separate from the first and second cylinder parts.

* * * * *